US006533033B2

(12) United States Patent
Skillman

(10) Patent No.: US 6,533,033 B2
(45) Date of Patent: Mar. 18, 2003

(54) PUMP PROTECTION SYSTEM

(76) Inventor: Dale Skillman, 317 Columbus St., P.O. Box 1214, Rapid City, SD (US) 57709-1214

( * ) Notice: Subject to any disclaimer, the term of this patent is extended or adjusted under 35 U.S.C. 154(b) by 211 days.

(21) Appl. No.: 09/737,447

(22) Filed: Dec. 13, 2000

(65) Prior Publication Data

US 2002/0139526 A1 Oct. 3, 2002

Related U.S. Application Data

(60) Provisional application No. 60/202,531, filed on May 10, 2000.

(51) Int. Cl.[7] ..... E21B 43/12

(52) U.S. Cl. ..... 166/105.1; 166/157; 166/205; 166/227

(58) Field of Search ..... 166/68, 74, 105.1, 166/105.3, 107, 157, 205, 227

(56) References Cited

U.S. PATENT DOCUMENTS 4,260,016 A * 4/1981 Calderon ..... 166/74
5,409,061 A * 4/1995 Bullick ..... 166/278
6,328,103 B1 * 12/2001 Pahmiyer et al. ..... 166/250.17

* cited by examiner

*Primary Examiner*—David Bagnell
*Assistant Examiner*—Zakiya Walker
(74) *Attorney, Agent, or Firm*—Gene R. Woodle

(57) ABSTRACT

Embodiments of a pump protection system are disclosed which may be used to enclose, protect, and improve the efficiency of a submersible pump. The pump protection system of the instant invention prevents unwanted materials from clogging the pump intake port and from entering the pump intake port to damage the internal parts of the pump. The pump protection system may be back flushed to clean the pump protection system without damaging the pump. The pump protection system also prevents entrained gasses from entering the pump. A pressure relief valve is also disclosed which provides back pressure on the pump at pump startup.

5 Claims, 6 Drawing Sheets

PUMP PROTECTION SYSTEM

REFERENCE TO RELATED APPLICATION

This application claims the benefit of Provisional Patent Application filed by Dale Skillman entitled Pump Shroud. This Provisional Patent Application was filed May 10, 2000 and assigned application No. 60/202,531.

BACKGROUND OF THE INVENTION

1. Field of the Invention

The present invention relates generally to pumping of natural resources from below ground to the surface and more specifically to devices to protect and improve the efficiency of pumps used for such purposes.

2. Background Information

In the United States and throughout the world, a variety of natural resources including oil, water, and methane (a natural gas), are found beneath the earth's surface and brought to the surface through a variety of wells. In some instances these resources are under pressure and will naturally flow through the well to the surface without application of other means. In other cases, a pump which has much of its components on the surface is used to pump the resource from the ground. In some instances, a pump, often a submersible pump, is placed beneath the surface in a production zone within or near the source of the resource.

In most cases in which an underground pump is used, a hole is drilled from the surface to the production zone and a pipe of some type is inserted into the hole between the surface and the production zone. The well is often "cased" by forcing concrete into the area between the outer surface of the pipe and the surface of the hole. The area near the production zone (the area within or near the source of the resource) is usually below the pipe and casing or placed in communication with the inside of the pipe or pipe and casing by the inclusion of holes in the pipe and/or casing. If an underground pump is used, the pump is suspended beneath the surface in the production zone.

The extraction of methane from coal deposits in many western states provides a good example of a well which uses an underground pump. The methane gas is entrained in water which permeates porous and permeable layers of coal found beneath the surface. A hole is drilled from the surface to the top of the coal deposit. The hole is cased with pipe from the surface to the top of the coal deposit. The production zone is a hole within the coal and is open to the cased area. A delivery pipe runs within the cased pipe from the surface to the production area and a submersible pump is affixed to the underground end of the delivery pipe. Ordinarily, water and methane will seep from the coal into the hole around the pump. The water and a small amount of methane are pumped through the delivery pipe to the surface where the water and methane are separated. Most of the methane flows up the cased hole outside the delivery pipe and is then removed and processed. The removal of water and methane from the production zone causes a pressure differential between the area close to the pump and outlying areas which tends to cause the water and methane to flow from the coal to the production zone near the pump.

A number of conventional submersible pumps may be used for this purpose and nearly all of them have a screened intake port through which the water enters the pump body. The water drawn into the pump also includes fine coal particles and other solid matter. Usually, after a period of operation, the solid particles (including coal particles) clog the pump's intake port and, more importantly, the pump impellers within the pump. Such clogging causes a variety of problems. The most obvious problem arising from clogging is that the extraction of water stops and methane production falls off dramatically or ceases, because there is no longer a pressure differential between the production zone and the surrounding area of the coal deposit. In addition, if the pump continues to operate with little or no flow of water, the pump will overheat and eventually fail. In many cases where the pump's intake port or pump impellers are clogged, the pump must be retrieved from the hole and cleaned. In cases where the pump fails or is damaged, the pump must be retrieved and either replaced or repaired. Often a system of sensors and controls are employed which sense that the intake port is clogged and the pump is laboring and the pump is automatically shut off.

Another significant problem which arises with the use of submersible pumps is overheating.

Another problem in coal bed methane production is associated with wells which are particularly "gassy." That is, significant amounts of methane are pumped up through the delivery pipe with the water and do not flow up the well outside of the delivery pipe. In most cases this results in significant amounts of methane being lost.

Another problem associated with submersible pumps, especially higher horsepower pumps, is pump failure caused by what is known as "upthrust." Most submersible pumps are manufactured as a series of stages stacked within a cylindrical case. Each stage includes an impeller and all of the impellers are usually powered by a single electric motor. When the pump is started up, the first stage impels the liquid up into the second stage and then the first and second stages impel the liquid up into the third stage. This process continues until all the stages are engaged and the liquid is forced out of the pump. As each stage is engaged, it adds its pumping force to the force provided by the previous stages. At startup, this combination of the upward force imparted by the lower stages of the pump or upthrust causes considerable wear and fatigue upon the elements of the upper stages of the pump. In some cases, a pump will even fail immediately upon startup because the upthrust of the lower stages of the pump cause failure of one or more of the upper stages.

The invention presented in the present application is believed to solve, in a simple and effective fashion, problems which have long plagued persons engaged in pumping resources from a well with a submersible pump: a pump protection system which provides a screen between the production zone and the pump intake port to prevent unwanted solids from reaching and clogging the pump intake port, which provides a method of cleaning such solids from the screen without removing the pump protection system or the pump from the production zone, which acts to eliminate or greatly reduce entrained gases from moving with the pumped fluid through the delivery pipe, which acts to prevent overheating, and which prevents pump failure due to upthrust at startup.

Although the pump protection system of the instant invention may be used in a variety of situations for extraction of a variety of resources, the following example is based upon the extraction of methane and water from underground coal seams, such methane is often described as "coal bed methane." The well is as described above. The pump protection system of the instant invention is attached to the delivery pipe near the bottom of the delivery pipe and completely surrounds the pump. The water from the production zone must pass through a protection system screen before it enters the intake port of the pump. If the protection system screen becomes clogged, a self-cleaning method is provided such that the system may be back-flushed and particles removed from the protection system screen with no reverse flow through the pump. The pump protection system of the instant inventions solves problems related to overheating by preventing clogging in a manner which also provides for a flow of cooling fluid around of the pump motor. The configuration of the pump protection system and the flow path of water within the pump protection system also helps to prevent methane from flowing with the water through the delivery pipe. The pump protection system of the instant invention also includes a pressure relief valve which acts to prevent upthrust damage at pump startup.

The ideal pump protection system should screen unwanted solid particles from reaching the intake port of the pump and clogging the intake port or jamming or causing excessive wear of the internal pump impellers. The ideal pump protection system should also provide a self-cleaning method whereby solid particles which collect upon the protection system screen may be flushed from the protection system screen without retrieving the pump or pump protection system from the production zone and without back flow through the pump. The ideal pump protection system should also help to prevent overheating of the pump and pump motor. The ideal pump protection system should also act to prevent gases from being pumped with the water through the delivery pipe. The ideal pump protection system should also include a method of preventing upthrust damage to the involved pump. The ideal pump protection system should also be simple, rugged, inexpensive, and easy to use.

SUMMARY OF THE INVENTION

In situations in which liquid or gaseous resources are pumped from beneath the ground to the surface, the present invention provides a pump protection system which screens unwanted solid particles from the pump intake port and prevents them from clogging the pump intake port or from jamming the pump's internal impellers. The production zone is the area around the pump intake port and the pump protection system may be employed in situations in which the entire pump (with intake port) is in or near the productions zone or in which the intake port is in the production zone and at least part of the pump is at the surface or otherwise outside the production zone.

Although the pump protection system of the instant invention may be used in a variety of situations, the following example is based upon the pumping of water and extraction of methane from a coal seam as described above. A typical well has an enclosed portion between the surface and a position near the top of the production zone. The well is open and in communication with the water and methane bearing coal at and near the production zone. A delivery pipe runs from the surface within the enclosed portion of the well to the production zone. A top valve flange is affixed to the lower end of the delivery pipe. The outflow port of a pump is affixed to a bottom valve flange and the bottom valve flange is connected to the top valve flange. A valve is seated between the top valve flange and the bottom valve flange. The top valve flange, bottom valve flange, and the valve make up a valve assembly.

The outer portion of the pump protection system, the shell, includes an upper seal cap at its top, a middle body portion, and a lower cap. The upper seal cap fits around the delivery pipe just above the top valve flange and forms a waterproof seal around the delivery pipe. The body of the pump protection system completely surrounds and encloses the valve assembly and the pump, and, thus, the pump intake port. The lower cap closes the bottom of the body and serves to center the assembly during insertion into the production zone. The lower portion of the body of the pump protection system is composed of a screen with a mesh sufficiently fine to allow water to enter the shell, but to prevent nearly all entrained coal particles, and other unwanted solid particles from entering the shell. The pump protection system is also designed so that methane which is entrained in the water entering the protection system flows back out of the protection system and up the well outside the delivery pipe.

The valve assembly may also include a pressure relief valve which acts to prevent upthrust damage to the pump. It is well known that back pressure greatly reduces or eliminates pump damage caused by upthrust. That is, a sufficient amount of downward pressure upon the upper stages of a pump counteracts and eliminates or greatly reduces the upthrust damage caused to the upper stages of a pump by the upward force of the lower stages. For example, after a pump has been in operation for a while, the downward force of the column of water above the pump is usually sufficient to counteract the upthrust and greatly reduces or eliminates the upthrust damage to the upper pump stages. In most cases, the amount of downward pressure sufficient to counter upthrust damage is known. As another example, a column of water in the delivery pipe 170 feet high might provide sufficient back pressure with a ten horsepower submersible pump to counteract the negative affects upon the pump of pump upthrust. In this example, the pressure relief valve would allow the system to back flush to clean the screen as long as the column of water in the delivery pipe was greater that 170 and would stop the flow of water back through the pump protection system when the column reached the height of 170 feet. Therefore, when the pump was restarted, upthrust damage would be reduced or eliminated because the back pressure of the 170 foot column of water on the upper stages of the pump would be sufficient to counteract the upthrust of the lower pump stages. At initial startup, upthrust damage could be curtailed by the simple expedient of filling the delivery pipe with water and allowing the water level to reach the 170 foot depth automatically because of the pressure relief valve.

In operation, the pump pumps water from the production zone up to the surface through the delivery pipe. The water and methane from the production zone are collected, separated, and cleaned in processes which are not considered part of the instant invention. The removal of water and methane from the production zone near the pump causes a pressure differential which, in turn, causes additional water and methane to flow from outlying areas into the production zone. In this pumping mode, the valve opens in a manner which allows the water to flow through the pump outflow port and up the delivery pipe. The water flows into the shell through the screen which catches solid particles and prevents them from entering the pump intake port. The pump protection system is designed such that relatively high velocity water flows around the pump motor and provides a cooling effect. Various methods, including monitoring the amount of current the pump is drawing, may be used to determine whether the screen has become sufficiently clogged to prevent appropriate amounts of water from flowing through the screen and into the shell. At this point the pump is shut off leaving a significant column of standing water within the delivery pipe above the pump. The valve is designed such that it is open between the pump outflow port and the delivery pipe when the pump is pumping water, but is closed between the outflow port and the delivery pipe when the pump is shut off. When this pumping path is closed, the valve automatically opens a second path, the cleaning path, which places the column of water within the delivery pipe into communication with the inside of the shell outside of the pump. The pressure head in the column of water is greater than the pressure from the water in the productions zone, and the water within the delivery pipe flows downward through the delivery pipe, through the shell, and out of the shell through the screen. This reverse flow of water or back flush acts to clean the screen. The operator may restart the pump and resume operations at any time during the gravity back flush.

The pressure relief valve portion of the valve assembly is open during the above described back flush operation as long as the column of water within the delivery pipe is higher than is sufficient to counteract upthrust damage and allows water to flow in the path described above to clean the screen. However, once the column of water reaches the level necessary to counteract upthrust, the pressure relief valve acts to close the water flow path through the pump protection system and prevents further back flush flow.

A flow tube within the shell projects downward below the pump to a position close to but above the bottom of the shell. Thus, when the pump is in pumping mode, the flow of water into the shell is in through the screen, downward toward the bottom of the shell, and then upward to the pump intake port. Although most of the methane does not pass through the screen, some enters through the screen with the water. This flow path causes much of the methane which enters through the screen into the shell to bubble up outside the flow tube and out through the screen near the top of the screen. This methane then flows outside the delivery pipe to the surface and does not flow with the water up through the delivery pipe. This greatly reduces the problems associated with surging current and torque and methane loss in gassy wells as described above.

Although the above summary relates to extraction of water and methane from a coal seam, the instant invention could be used in a number of situations where a liquid containing solid particles which could clog a pump intake port is pumped from underground to the surface. The pump protection system could even be used in situations in which the pump was located entirely above ground as long as there was some form of pump intake port beneath the surface.

One of the major objects of the present invention is to provide a pump protection system which screens unwanted solid particles from reaching the intake port of the pump and clogging the intake port and from jamming internal pump impellers and from causing excessive wear.

Another objective of the present invention is to provide a self-cleaning method whereby solid particles which collect upon the protection system screen may be flushed from the protection system screen without retrieving the pump or pump protection system from the production zone.

Another objective of the present invention is to help to prevent overheating of the pump motor.

Another objective of the present invention is to provide a pump protection system which prevents methane entrained in the water entering the pump protection system from flowing through the pump.

Another objective of the present invention is to reduce or eliminate upthrust damage by maintaining sufficient back pressure within the delivery pipe at the pump discharge to counteract upthrust damage.

Another objective of the present invention is to provide a pump protection system which is simple, rugged, inexpensive, and easy to use.

These and other features of the invention will become apparent when taken in consideration with the following detailed description and the drawings.

DESCRIPTION OF A PREFERRED EMBODIMENT

Figure 1:
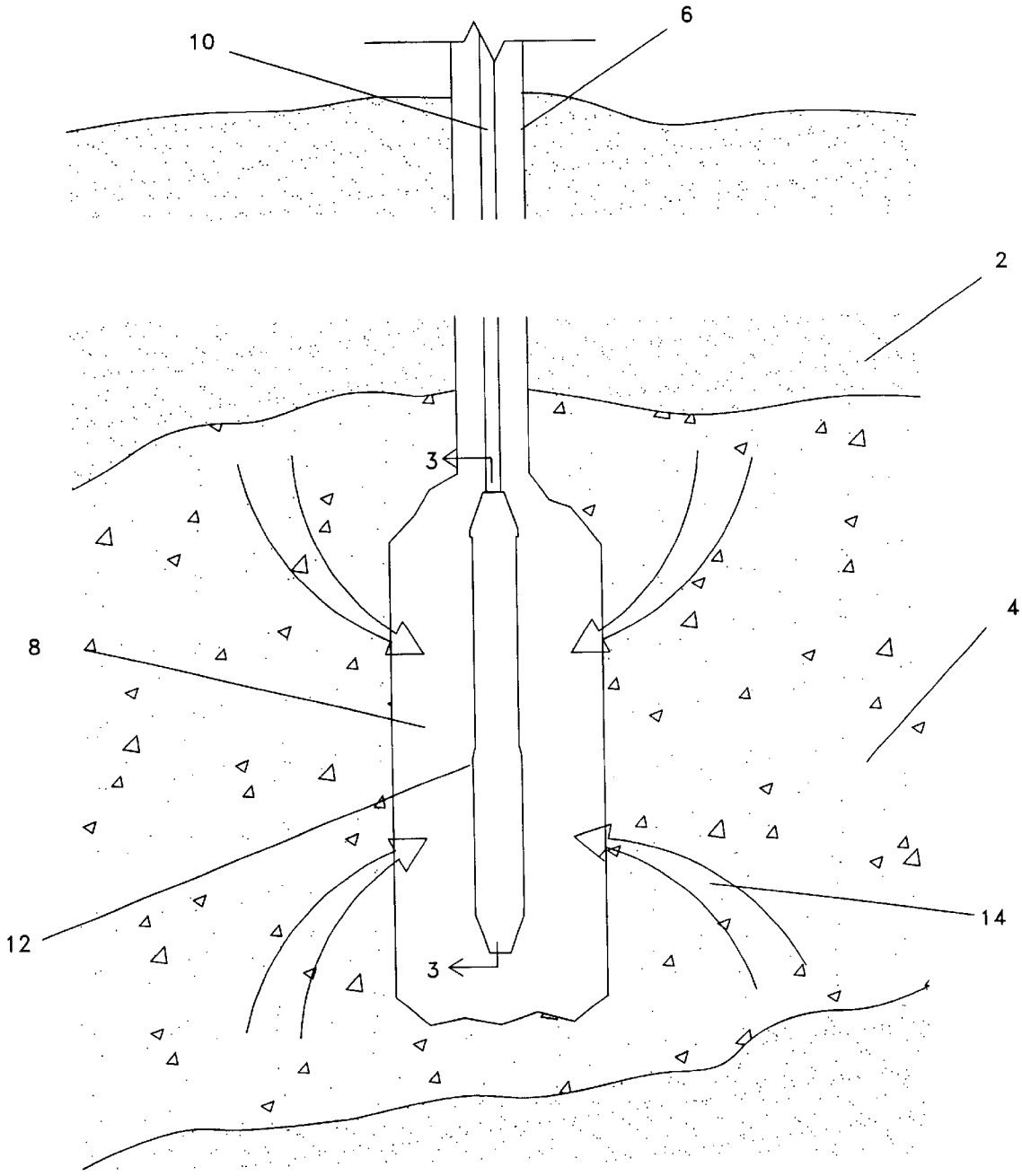
FIG. 1 is a side view of a well pumping system including the pump protection system of the instant invention.

Referring to the drawings, FIGS. 1 through 5B and 7, there is shown a preferred form of the pump protection system embodying the present invention. The pump protection system of the instant invention may be used to prevent clogging, promote cooling, and self-clean any pumping system in which the pumping system includes a pump intake port which is susceptible to being clogged by unwanted solid particles.

Referring to FIG. 1, a side view of a well pumping system including the pump protection system of the instant invention is shown. Although the pump protection system could be used in a variety of situations, the system depicted in FIG. 1 will be used for a description of a preferred embodiment of the instant invention. Area 2 depicts any type of underground composition. Coal seam 4 depicts a coal seam within area 2 which is porous and permeable and contains water and methane. Well casing 6 is an enclosed section (usually by some type of pipe) which runs from the surface to the coal seam 4. A production zone 8 is an open area which is not enclosed at the bottom of the well casing 6. The production zone 8 is within said coal seam 4 and is usually under reamed (under reaming generally creates an open hole below the well casing 6) after the well is drilled. A delivery pipe 10 runs inside said well casing 6 from the surface to said production zone 8. The pump protection system 12 of the instant invention is affixed to the bottom of the delivery pipe 10 and is located within said production zone 8. The arrows 14 indicate the flow of water and methane from said coal seam 4 into said production zone 8. A pump (not shown in this Figure) inside the pump protection system 12 pumps the water from said production zone 8 through said delivery pipe 10 to the surface. At the surface the water and methane are processed, but this process is not considered a part of the instant invention. Most of the methane does not enter said pump protection system 12 and flows up said well casing 6 outside of said delivery pipe 10; however, there is a small amount of methane entrained in the water which enters said pump protection system 12, and this entrained methane is discussed below. Said area 2, said coal seam 4, said well casing 6, said production zone 8, and said delivery pipe 10 are of conventional configuration and are also not considered a part of the instant invention.

Figure 2:
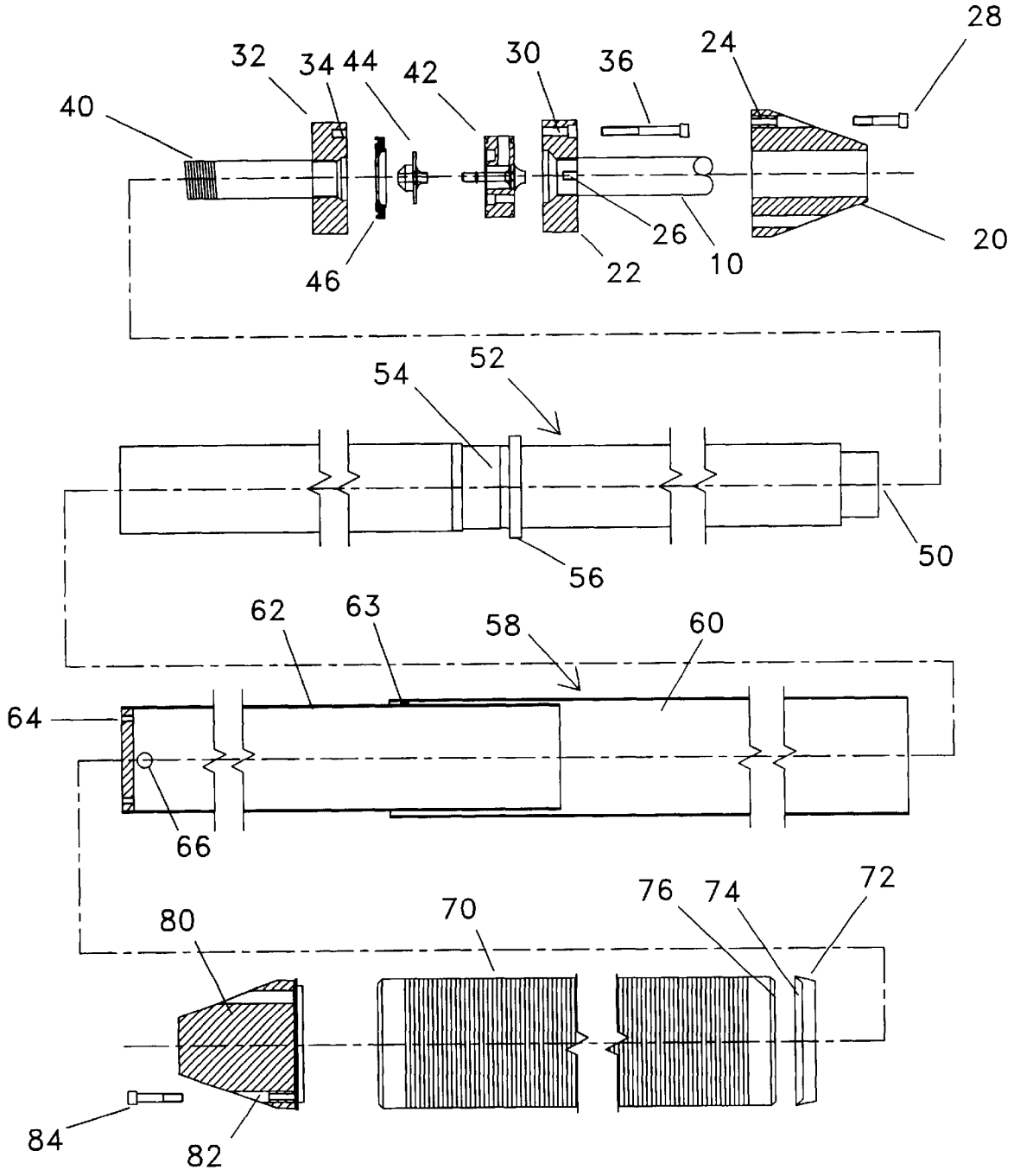
FIG. 2 is an exploded side view of the pump protection system of the instant invention.

Referring now to FIG. 2, an exploded view of the pump protection system of the instant invention is shown. An upper seal cap 20 fits around said delivery pipe 10 near the bottom of said delivery pipe 10 and forms a waterproof seal around said delivery pipe 10. The upper seal cap 20 tapers inward and upward to prevent the assembly from getting hung up in the well during extraction. A top valve flange 22 is affixed to the very bottom of said delivery pipe 10. There is a series of cap holes 24 around the circumference of said upper seal cap 20 which are parallel with the longitudinal axis of said delivery pipe 10. There is a complimentary series of top cap holes 26 in the top of the top valve flange 22. The top cap holes 26 are threaded and do not pass entirely through said top valve flange 22. Said upper seal cap 20 is affixed to said top valve flange 22 by screwing cap bolts 28 into said top cap holes 26. Said top valve flange 22 includes a series of top flange holes 30 around its perimeter which are also parallel to said delivery pipe 10. For clarity, said top cap holes 26 and said top flange holes 30 are shown as being aligned, but these holes are actually offset. A bottom valve flange 32 is provided which includes a series of threaded bottom flange holes 34 which are complimentary to said top flange holes 30. The bottom valve flange 32 is affixed to said top valve flange 22 by screwing flange bolts 36 through said top flange holes 30 into the bottom flange holes 34. An outflow pipe 40 is affixed to and protrudes downward from said bottom valve flange 32. The bottom end of the outflow pipe 40 is threaded. A valve guide 42, a valve 44, and a valve seat 46 are interposed between said top valve flange 22 and said bottom valve flange 32.

Still referring to FIG. 2, said outflow pipe 40 screws into the outflow port 50 of a pump 52. The intake port 54 of the pump 52 may be located at various positions, but is ordinarily near the center of said pump 52. A seal 56 is slid onto the body of said pump 52 and is positioned above the intake port 54. A shell 58 encloses said pump 52. The shell 58 includes a top shell 60 and a bottom shell 62. The top of the top shell 60 fits flush against the bottom of said upper seal cap 20 and is affixed to said top valve flange 22 and said bottom valve flange 32. Said top shell 60 is hollow with open ends. The bottom shell 62 is affixed at its top to the bottom of said top shell 60. Said bottom shell 62 is hollow and is open at its top and closed at its bottom. The seal 56 is a cylindrical seal between said bottom shell 62 and said pump 52 which prevents the flow of liquid from the area above said seal 56 to said intake port 54 within said bottom shell 62. There is a series of threaded shell holes 64 around the perimeter of the base of said bottom shell 62 which are parallel to the longitudinal axis of said delivery pipe 10 and a series of flow holes 66 near the bottom of said bottom shell 62 which are perpendicular to the longitudinal axis of said delivery pipe 10. The outer surface of the seal 56 makes contact with the inner surface of said bottom shell 62 and keeps said pump 52 centered within said bottom shell 62. A series of shell spacers 63 are affixed to the outer surface of said bottom shell 62 near the top of said bottom shell 62. The shell spacers 63 are also affixed to said top shell 60 near the bottom of said top shell 60 and act to hold said bottom shell 62 concentric within said top shell 60. Said shell spacers 63 are configured such that the interior of said top shell 60 remain in communication with the exterior of said bottom shell 62.

Still referring to FIG. 2, a screen 70 fits over and encloses the bottom portions of said shell 58 and is sealed at its top by a screen gasket 72. The screen gasket 72 slides onto said shell 58 and includes a female groove 74 at its base which accepts a male ridge 76 on the top of the screen 70. A bottom cap 80 includes a series of bottom cap holes 82 around its perimeter which are complementary to the shell holes 64 in said bottom shell 62. The bottom cap 80 is affixed to said bottom shell 62 by screwing bottom bolts 84 through the bottom cap holes 82 into said shell holes 64. The top of said bottom cap 80 contacts the bottom of said screen 70 and holds said screen 70 in place. Said screen 70 is of sufficient length that the top of said screen 70 is above the bottom of said top shell 60.

Figure 3A:
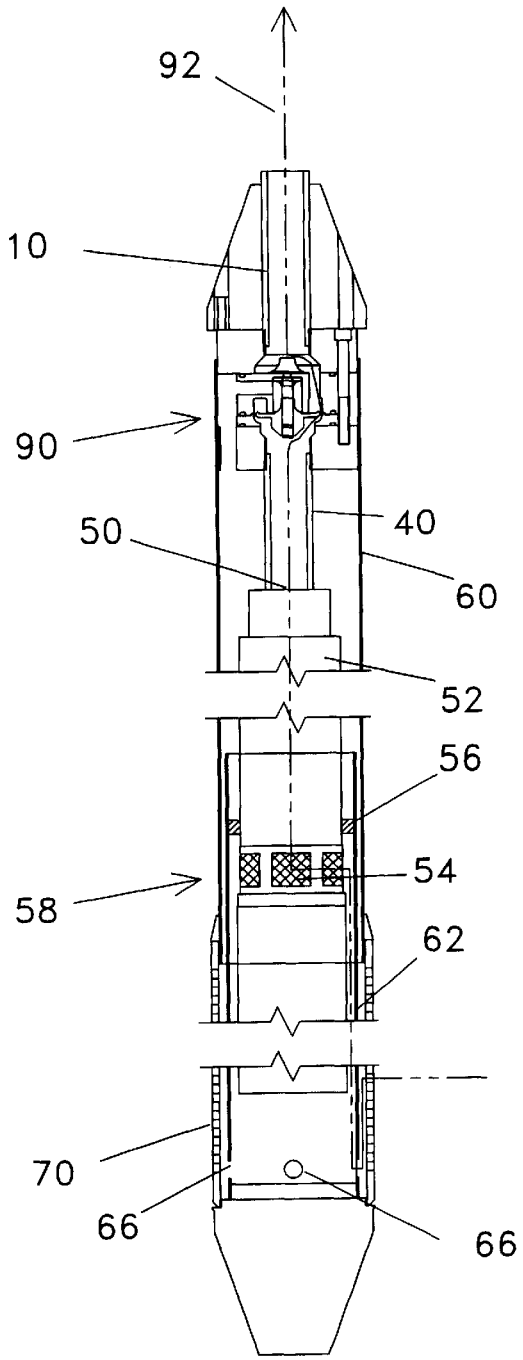
FIG. 3A is a side sectional view of the pump protection system of the instant invention taken along line 3—3 of FIG. 1 in pumping mode.

Now referring to FIG. 3A, a side sectional view of the pump protection system of the instant invention in pumping mode is shown. In pumping mode the said pump 52 is in operation and, as described above, the water is pumped from said production zone 8 through said delivery pipe 10 to the surface. FIG. 3A shows the flow of the water through said pump protection system 12 of the instant invention when the system is in pumping mode. This flow is shown by the pump mode flow arrow 92. The flow is into said pump protection system 12 through said screen 70 and downward along the outer surface of said bottom shell 62. The route of flow is then through said flow holes 66 into the interior of said bottom shell 62 upward across the outer surface of the motor of said pump 52 to said intake port 54 of said pump 52. The combination of said top valve flange 22, said bottom valve flange 32, the valve guide 42, the valve 44, and the valve seat 46 are referred to as a valve assembly 90. When in pumping mode, the valve assembly 90 is configured such that said outflow pipe 40 is placed in communication with said delivery pipe 10. Therefore, after the water enters said intake port 54, said pump 52 pumps the water out said outflow port 50, through said outflow pipe 40 and said valve assembly 90, into said delivery pipe 10. The water continues through said delivery pipe 10 up to the surface. The flow of the water around the motor of said pump 52 provides a needed cooling affect upon said pump 52. Details of said valve assembly 90 are discussed below. As mentioned previously, there is some methane entrained in the water which enters through said screen 70. The water and entrained methane must flow downward to reach said flow holes 66. Nearly all of the entrained methane bubbles up out of said screen 70 prior to reaching said flow holes 66 and, thus, is not pumped up said delivery pipe 10.

Figure 3B:
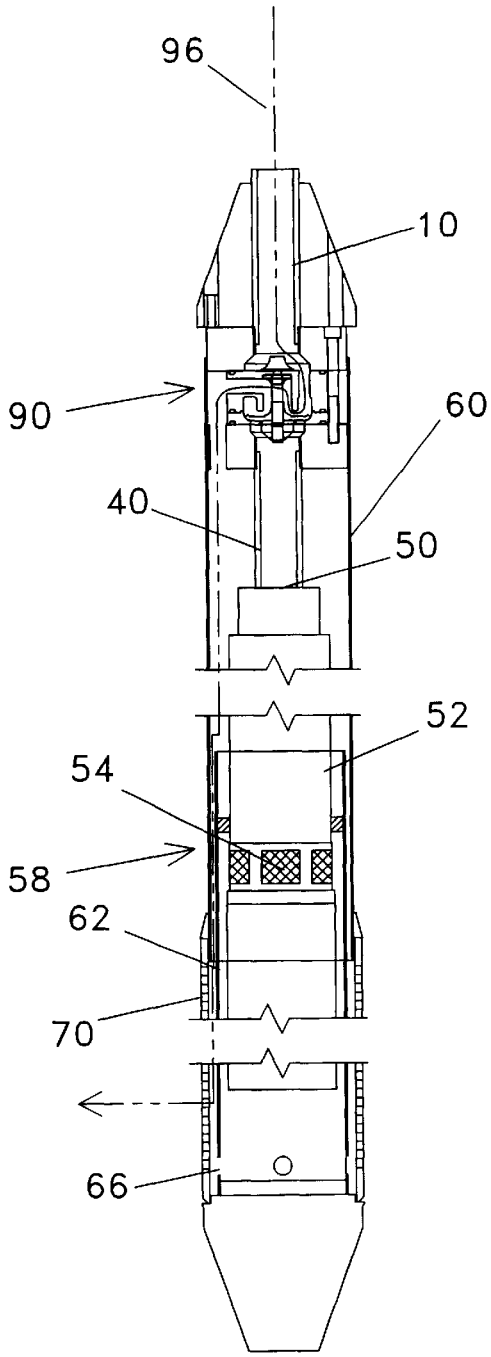
FIG. 3B is a side sectional view of the pump protection system of the instant invention also taken along line 3—3 of FIG. 1 in flushing mode.

Now referring to FIG. 3B a side sectional view of the pump protection system of the instant invention in flushing mode is shown. In this description, the water and methane contain particles of coal and other unwanted solids. In most other situations in which a liquid is pumped from the ground, the liquid contains other types of solid particles. The intake ports of all conventional submersible pumps include some device, usually a form of screen, to prevent the solid particles from being introduced into the pump where they would damage the pump. As fluid is pumped, these particles collect upon the screen and eventually collect in sufficient quantities to obstruct the flow through the pump. This obstruction of flow causes less product to be pumped to the surface and also tends to create wear and tear on the pump or even to ruin the pump. More importantly and more often, fine particles pass through the intake screen and jam the internal impeller of the pump. The pump must then be retrieved from the well and cleaned and repaired or replaced. In pumping mode, as described in the previous paragraph, the mesh of said screen 70 is of such a size that nearly all of the solid particles are trapped by said screen 70 and do not reach said intake port 54. This results in said pump 52 being able to operate a good capacity and efficiency for a longer period of time than a pump with a standard intake port screen, as the surface area of said screen 70 is much larger that the surface area of an intake port screen. Eventually, however, said screen 70 will become clogged with solid particles to a sufficient extent that said pump 52 does not operate efficiently or is in danger of being damaged. (It is well known that in most cases, when a pump which is intended to pump liquids continues to operate without sufficient liquid intake or when the pump's internal impellers are jammed; pump damage results.) Through a variety of means, including monitoring the amount of current an electric pump draws, the situation where said screen 70 becomes clogged may be detected. At this point, said pump 52 is shut off which leaves a column of water filling said delivery pipe 10.

Still referring to FIG. 3B, when said pump 52 is shut off, said valve assembly 90 is configured such that said delivery pipe 10 is no longer in communication with said outflow pipe 40, and the water can not flow back through said pump 52. Said valve assembly 90 does, however, direct the flow, as shown by flushing flow arrow 96, toward the interior of said shell 58 outside said pump 52. The weight of the water in said delivery pipe 10 causes the water to flow downward through said top shell 60, between the inner surface of said top shell 60 the outer surface of said bottom shell 62, and out of said pump protection system 12 through said screen 70. This reverse flow or back flushing removes solid particles from the outer surface of said screen 70 and unclogs said screen 70. After said screen 70 has been cleaned, said pump 52 may be turned on and the system returned to pumping mode as described above. As is clear from the flow depicted in FIG. 3A, this back flushing process does not involve a backward flow of water through the pump; thus, said pump 52 may be restarted, even during the back flush process, without damage to the motor or internal impellers of said pump 52.

Figure 4:
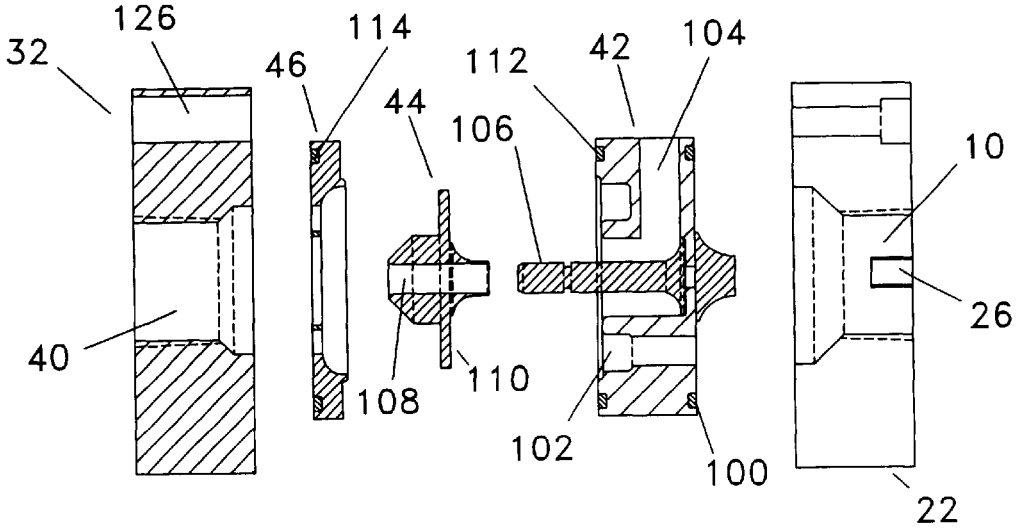
FIG. 4 is a sectional detail view of the valve assembly of the instant invention.

Referring now to FIG. 4, a sectional detail view of said valve assembly 90 of the instant invention is shown. As mentioned previously, said top valve flange 22 encloses and is affixed to the bottom of said delivery pipe 10. The top surface (shown to the right in FIG. 4) of said valve guide 42 abuts the bottom surface of said top valve flange 22 and includes an indentation which hold a top O-ring 100 to create a waterproof seal between said valve guide 42 and said top valve flange 22. There are eight up paths 102 (only one is shown) through said valve guide 42 which are a holes through said valve guide 42 which are not centered upon said valve guide 42, but which open at its top within the opening at the bottom of said delivery pipe 10. There is also a down path 104 through said valve guide 42 which comprises a hole perpendicular to the longitudinal axis of said delivery pipe 10 which runs from the outer surface of said valve guide 42 within said valve guide 42 to a point beyond the center of said valve guide 42 and a connected hole through the center of said valve guide 42 which opens through the bottom of said valve guide 42, but not through the top of said valve guide 42. A cylindrical guide stem 106 protrudes downward from the top of the down path 104 and from the center of said valve guide 42 and extends beyond the bottom of said valve guide 42. Said valve 44 includes a valve guide hole 108 through its longitudinal axis such that the guide stem 106 fits within the valve guide hole 108. Said valve 44 also includes a valve flap 110 which has the shape of a disk perpendicular to the longitudinal axis and is of sufficient diameter that the outer edge of the valve flap 110 protrudes beyond the outer limit of the up path 102. Said valve flap 110 is made of a flexible material. The valve seat 46 also has the shape of a disk with a diameter greater than the outside diameter of said outflow pipe 40. There is also a hole through the center of said valve seat 46 which is smaller than the outside diameter of said valve flap 110, but greater than the outside diameter of the body of said valve 44; such that the body of said valve 44 fits through the hole in said valve seat 46, but said valve flap 110 does not. A bottom O-ring 112 in a circular slot in the bottom of said valve guide 42 contacts and makes a seal with the top surface of said valve seat 46. A seat O-ring 114 in a circular slot in the bottom of said valve seat 46 contacts and makes a seal with the top surface of said bottom valve flange 32. Said bottom valve flange 32 includes a longitudinal bottom flange hole 126 near its perimeter. Although said bottom flange holes 34 are shown in FIG. 2 as being aligned with the bottom flange hole 126 for clarity, said bottom flange holes 34 are actually offset from said bottom flange hole 126.

Figure 5A:
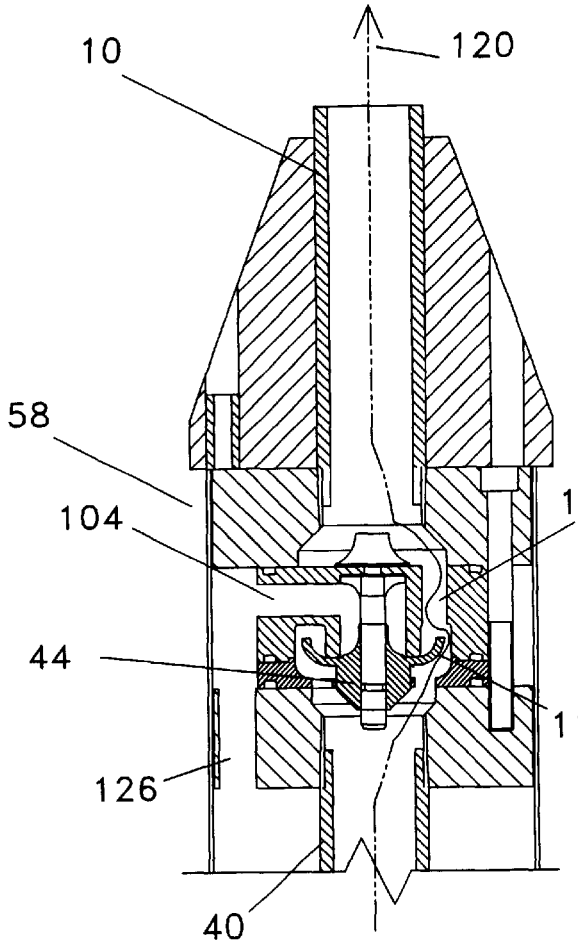
FIG. 5A is a sectional detail view of a portion of FIG. 3A in pumping mode.

Referring now to Figure 5A a sectional detail view of a portion of FIG. 3A in pumping mode is shown. In this mode, with said pump 52 pumping water up said outflow pipe 40, said valve 44 is slid up said guide stem 106 until the top surface of said valve flap 110 contacts the bottom surface of said valve guide 42. This action closes the entry to said down path 104 and prevents flow through said down path 104. The pressure of the water on the flexible valve flap 110 causes said valve flap 110 to bend upward at its outer edge which opens said up path 102 and allows flow of the water through said delivery pipe 10. This flow pattern in indicated by pump arrow 120.

Figure 5B:
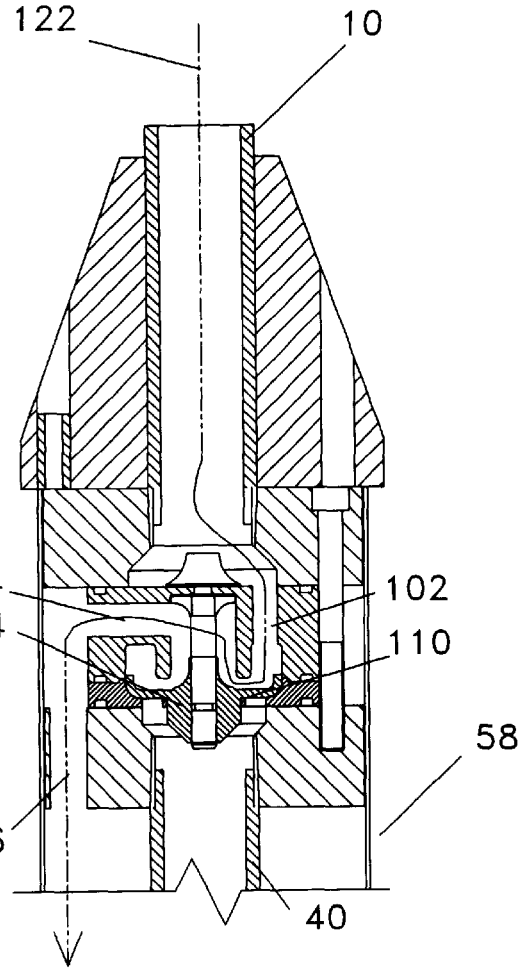
FIG. 5B is a sectional detail view of a portion of FIG. 3B in flushing mode.

Referring now to FIG. 5B a sectional detail view of a portion of FIG. 3B in flushing mode is shown. Is this mode said pump 52 is shut off and the water in said delivery pipe 10 forces said valve flap 110 of said valve 44 back against said valve seat 46. This action closes off the path down through said outflow pipe 40 and opens said down path 104. As indicated by flush arrow 122 the flow of water is down through said delivery pipe 10 through said up path 102, through said down path 104, down through the bottom flange hole 126 and into the body of said shell 58. The rest of the flow path is as described above.

Figure 6:
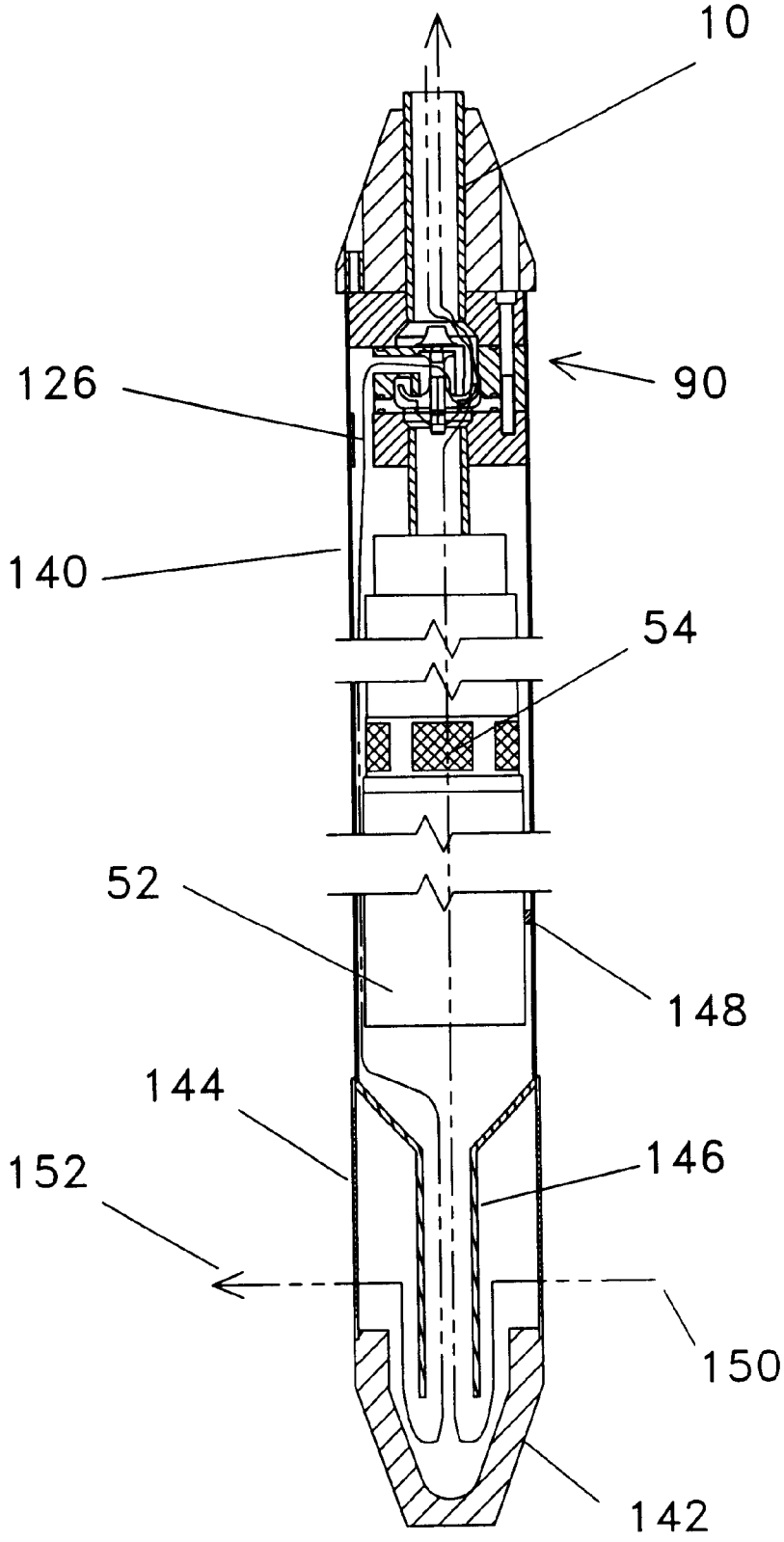
FIG. 6 is a side sectional view of a second embodiment of the pump protection system of the instant invention.

Now referring to FIG. 6, a side sectional view of a second embodiment of the pump protection system of the instant invention is shown. This embodiment is intended for use in situations in which a pump protection system having a smaller diameter is necessary. This embodiment has all of the same design and constructions features as the preferred embodiment described above accept for the elements or features described below. Rather than having a separate top shell 60 and bottom shell 62, this embodiment has a single small shell 140. This embodiment includes a bottom cap 142 rather than the bottom cap 80, and the bottom cap 142 is mechanically sealed to the bottom of the small shell 140 rather than being bolted on as in the preferred embodiment above. Said small bottom cap 142 also has a hollow interior. A small screen 144 performs the same function as said screen 70, but is affixed directly to the bottom of said small shell 140. A flow tube 146 is also affixed to the bottom of said small shell 140. The flow tube 146 has the general shape of a funnel with the large end of the funnel having the same diameter as the diameter of said small shell 140 and being affixed to said small shell 140. The small end of the funnel shape protrudes downward into the interior of said small bottom cap 142. There is a series of spacers 148 around the outer circumference of said pump 52 which contact the inner surface of said small shell 140 and act to position said pump 52 centered within said small shell 140. The spacers 148 do not prevent the top interior of said small shell 140 from being in communication with the bottom interior of said small shell 140.

Still referring to FIG. 6, the operation of this second embodiment of the pump protection system of the instant invention is the same as described above for the preferred embodiment, however, the flow patterns are slightly different. The pump mode flow is as indicated by small up flow arrow 150. The water flows through the small screen 144 and down into the interior of said small bottom cap 142. The flow then proceeds upward through the flow tube 146, passed said small spacers 148 around the pump motor for cooling and into said intake port 54. Said pump 52 then pumps the water up through said valve assembly 90 and said delivery pipe 10. In flush mode the flow is as indicated by small down flow arrow 152. The water comes down said delivery pipe 10, through said valve assembly 90 and said bottom flange hole 126 and downward through the interior of said small shell 140 outside said pump 52. The flow is then through said flow tube 146 and out through said small screen 144. As shown by the flow depicted by the small up flow arrow 150, the intake into said flow tube 146 is below the top of said small bottom cap 142. Thus, the water and any entrained methane must flow downward after entering through said small screen 144. As in the preferred embodiment described above, this causes the entrained methane to bubble up out of the top of said small screen 144 and not be pumped through said delivery pipe 10.

Figure 7:
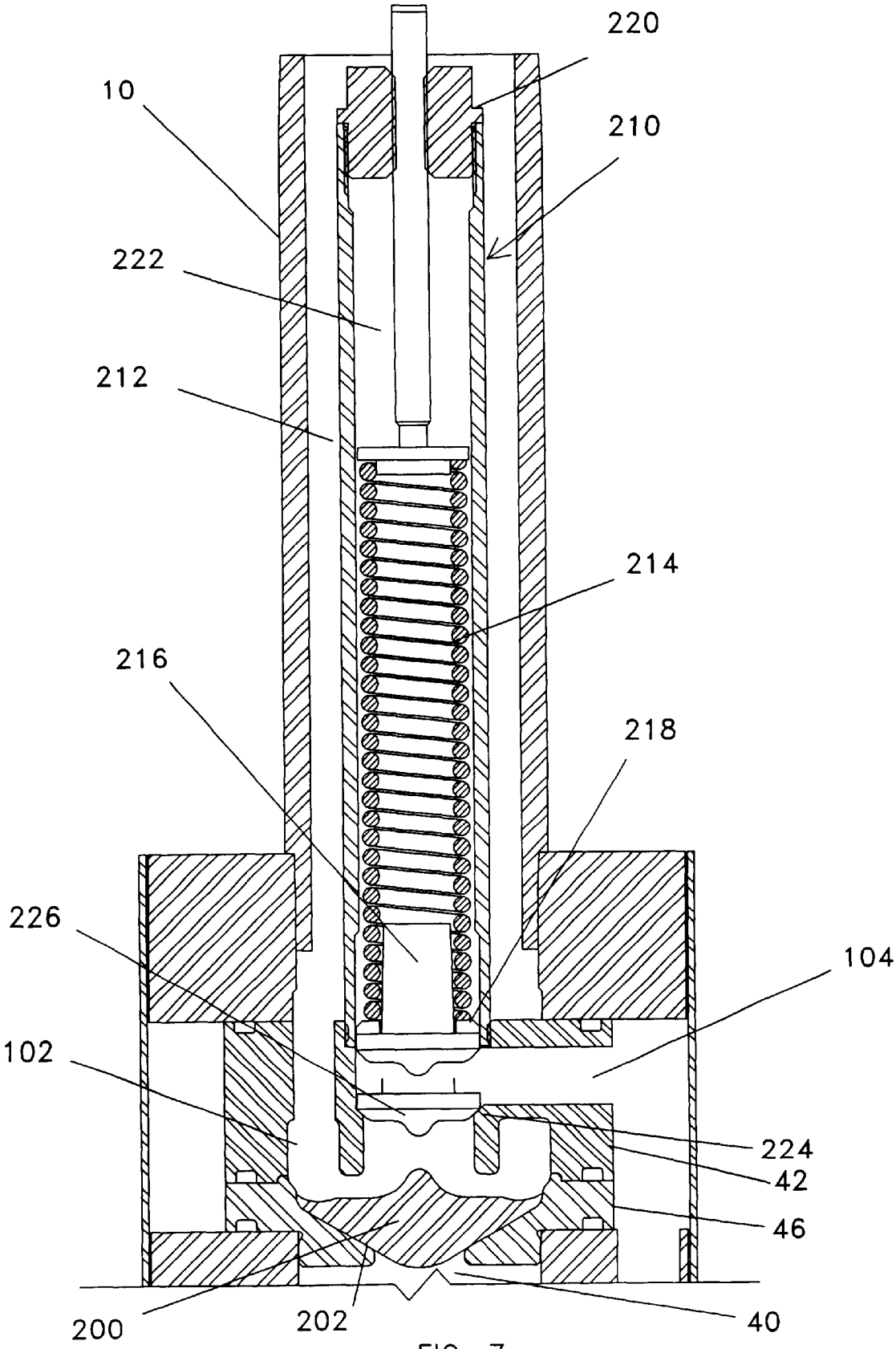
FIG. 7 is a side sectional view of the valve assembly of the instant invention showing the pressure relief valve and a second embodiment of the valve of the instant invention.

Referring now to FIG. 7, a second embodiment of said valve 44 is shown. As depicted in this figure, a shuttle 200 replaces several elements previously mentioned including said valve 44, said valve flap 110, said valve guide hole 108, and said guide stem 106. In this embodiment, said valve seat 46 is still generally cylindrical; but has a slightly different shape. In this embodiment said valve seat 46 includes a conical hole 202 which is capable of placing said up path 102 into communication with said outflow pipe 40. The conical hole 202 is wider at the top than at the bottom. The shuttle 200 has a bottom surface which has the same general size and shape as said conical hole 202. When said pump protection system 12 is in flush mode as described above, said shuttle 200 is forced by the pressure of the downward flowing fluid to seat within said conical hole 202 and prevents the flow of fluid from said up path 102 into said outflow pipe 40 and the fluid flows through said down path 104 as described above. When said pump protection system 12 is in pumping mode as described above, fluid is pumped upward through said outflow pipe 40 and the fluid forces said shuttle 200 upward such that the top surface of said shuttle 200 seats against said valve seat 46 and closes off said down path 104. Said shuttle 200 is sufficiently flexible that fluid may, however, pass through said up path 102 and out said delivery pipe 10.

Still referring to FIG. 7, a pressure relief valve assembly 210, is also shown. The bottom of a cylindrical spring tower 212 is affixed to the top of said valve guide 42 at the center of said valve guide 42. The interior of the spring tower 212 is in communication with the interior of said valve guide 42, said up path 102, and said down path 104. A spring 214 fits within said spring tower 212. A cylindrical pressure relief seal 216 has a bottom which has the same diameter as the inside diameter of said spring tower 212 and a top which has the same diameter as the inside diameter of the spring 214. The pressure relief seal 216 fits inside the bottom of said valve case 212 with the top of said pressure relief seal 216 fitting within said spring 214. The bottom of said spring 214 is capable of exerting downward force upon the upper surface of the bottom of said pressure relief seal 216. A washer 218 is interposed between said pressure relief seal 216 and the bottom of said spring 214 to insure uniform application of spring force upon said pressure relief seal 216. The top of said spring tower 212 is enclosed by a pressure relief valve cap 220 which has a vertical, threaded hole through its center. A threaded spring compressor 222 is threaded through the hole in the pressure relief valve cap 220. The bottom of the spring compressor 222 is in contact with the top of said spring 214 and the top of said spring compressor 222 protrudes upward from said pressure relief valve cap 220. The compression on said spring 214 may be adjusted by turning said spring compressor 222.

Still referring to FIG. 7, upthrust, as has been described above, is a phenomenon which causes wear on submersible pumps and often results in pump failure. The deleterious effects of upthrust can be counteracted by insuring a known amount of back pressure against the upper sages of a submersible pump at pump startup. In the pump protection system of the instant invention, this back pressure is created by insuring that a sufficient column of fluid is present in said outflow pipe 12 to maintain the required back pressure. In pumping mode, said spring 214 forces said pressure relief seal 216 downward and said pressure relief seal 216 seats against a cylindrical pressure relief seal seat 224 on the top surface of said valve guide 42. This position is indicated in the figure by the partial version of said pressure relief seal 216 indicated at pressure relief seal position 226. In pressure relief seal position 226, said down path 104 is closed off and is not in communication with said up path 102 or said outflow pipe 40. In flushing mode, the force of the column of fluid in said delivery pipe 10 is sufficient to counteract the force of said spring 214 and said pressure relief seal 216 is forced upward to the position shown for pressure relief seal 216. In this position, said down path 104 is in communication with said up path 102 and the fluid may enter said shell 58 (not shown in this figure) and flush out said screen 70 (also not shown in this figure). When the height of the column of fluid has been reduced to the height of the column necessary to counteract the effects of upthrust, the force of said spring 214 upon said pressure relief seal 216 is sufficient to overcome the force of the column of fluid upon said pressure relief seal 216 and said pressure relief seal 216 is forced downward and seated as shown in pressure relief seal position 226. This acts to shut off said down path 104 and, thus, the column of fluid necessary to counteract upthrust is maintained within said delivery pipe 10. When the pump is restarted and pumping mode resumed, the remaining column of fluid exerting force downward on the upper stages of the pump, is sufficient to counteract upthrust. The height of the column of fluid necessary to counteract upthrust damage may be adjusted by changing the compression on said spring 214 using said spring compressor 222. The affects of upthrust at initial startup of the pump may be counteracted by not starting the pump until fluid has been introduced into said delivery pipe 10.

In operation, fluid is pumped from said production zone 8 through said screen 70 into the interior of said shell 58. The fluid flows through said up path 102 and out said delivery pipe 10. Solid particles in the fluid are trapped by said screen 70 and prevented from entering the interior of said shell 58. Because the fluid must flow downward prior to entering said flow holes 66 in said bottom shell 62 or the intake area of said flow tube 146, most gases entrained in the fluid bubble up and exit said shell 58 through said screen 70 prior to reaching said pump 52 and are not pumped up through said delivery pipe 10. Said bottom shell 62 and said flow tube 146 serve similar functions in that they force fluid to move downward prior to entering said pump 52 and both may be considered a baffle to direct the flow of fluid prior to entering said pump 52. Although baffles such as said bottom shell 62 and said flow tube 146 are shown, other baffles providing the same function could be used. In flushing mode, said pump 52 is shut off and fluid from said delivery pipe 10 is routed outside said pump 52 through said screen 70 and into said production zone 8. This flow of fluid acts to flush solid particles away from said screen 70. In flushing mode said pressure relief valve assembly 210 allows the flow of fluid from said delivery pipe 10 until the level of fluid in said delivery pipe 10 reaches a certain predetermined level. Once this predetermined level has been reached, said pressure relief valve 210 closes and maintains the fluid at this predetermined level. Once said pump 52 is restarted, the back pressure caused by the fluid which remains in said delivery pipe 10 is sufficient to counteract the damage to said pump 52 caused by upthrust which has been previously discussed.

In the preferred embodiment of the pump protection system of the instant invention, all parts and elements, except those specifically mentioned below, are made from stainless steel; but other materials having the same strength, weight, resistance to oxidation, etc. could be used. Said valve 44 is made from rubber and brass, but other materials having the same properties could be used. The upper seal caps, bottom caps, said seal 56, said shell spacers 63, and said screen gasket 72 are molded from a polyurethane elastomer.

While preferred embodiments of this invention have been shown and described above, it will be apparent to those skilled in the art that various modifications may be made in these embodiments without departing from the spirit of the present invention.

I claim:

1. A pump protection system for use with a well pump in which the well pump pumps a fluid from a production zone near the well pump from which fluid may be pumped to a discharge point; the well pump having an intake port through which the fluid enters the pump and a delivery pipe through which the fluid is pumped; and the well pump having a pumping mode in which fluid is pumped from the productions zone through the delivery pipe and having a back flush mode in which fluid flows from the delivery pipe into the production zone which comprises:

(1) a shell which completely surrounds the well pump and through which any fluid must pass before it enters the intake port of the well pump and through which any fluid which flows from the delivery pipe into the production zone must pass prior to reaching the production zone;

(2) a screen which makes up a portion of the shell; the screen being of sufficiently small mesh that most of any solid particles within the fluid within the production zone are stopped from entering said shell by said screen when the well pump is in pumping mode; and (3) a valve interposed between the delivery pipe and the well pump intake port inside said shell; the valve allowing flow of fluid from the well pump through the delivery pipe when the well pump is in pumping mode; the valve preventing flow of fluid from the delivery pipe from entering the well pump; and said valve directing the flow of fluid from the delivery pipe into the interior of said shell and through said screen into the production zone such that this flow flushes solid particles caught by said screen into the production zone when the well pump is in back flush mode;

whereby a well pump may be surrounded by said shell including said screen—such that any solid particles in the fluid to be pumped are trapped in the screen and do not enter the intake port of the well pump and solid particles trapped in said screen may be flushed away from said screen by back flushing fluid from the delivery pipe through said screen.

2. The pump protection system of claim 1 in which a baffle is introduced into said shell such that fluid from the production zone must travel in through said screen and downward to a position near the bottom of said shell before the fluid may enter the intake port of the well pump.

3. The pump protection system of claim 2 which a pressure relief valve is interposed between the delivery pipe and the well pump and the pressure relief valve prevents fluid in the delivery pipe from flowing out through said shell once the fluid level within the delivery pipe reaches a specific level when the well pump is in back flush mode and the fluid level within the delivery pipe is maintained at the specific level until the well pump is returned to pumping mode.

4. The pump protection system of claim 1 in which a pressure relief valve is interposed between the delivery pipe and the well pump and the pressure relief valve prevents fluid in the delivery pipe from flowing out through said shell once the fluid level within the delivery pipe reaches a specific level when the well pump is in back flush mode and the fluid level within the delivery pipe is maintained at the specific level until the well pump is returned to pumping mode.

5. The pump protection system of claim 4 in which a baffle is introduced into said shell such that fluid from the production zone must travel in through said screen and downward to a position near the bottom of said shell before the fluid may enter the intake port of the well pump.

* * * * *